United States Patent [19]

Chou et al.

[11] Patent Number: 4,997,544

[45] Date of Patent: Mar. 5, 1991

[54] HYDROCONVERSION PROCESS

[75] Inventors: Tai-Sheng Chou, Pennington, N.J.; Clinton R. Kennedy, West Chester, Pa.; Stuart S. Shih, Cherry Hill, N.J.

[73] Assignee: Mobil Oil Corporation, Fairfax, Va.

[21] Appl. No.: 350,865

[22] Filed: May 12, 1989

[51] Int. Cl.[5] ..... C10G 23/00

[52] U.S. Cl. ..... 208/59; 208/89; 208/97; 208/211; 208/212; 208/254 H; 208/301; 208/302; 208/149

[58] Field of Search ..... 208/89, 97, 301, 302, 208/212, 211, 254 H, 149, 59; 502/21, 527

[56] References Cited

U.S. PATENT DOCUMENTS

| | | | |
|---|---|---|---|
| 2,791,544 | 5/1957 | Eastwood | 208/89 |
| 2,813,140 | 11/1957 | Turpin | 208/89 |
| 3,184,403 | 5/1965 | Gardner et al. | 208/89 |
| 3,663,424 | 5/1972 | Jaffe | 208/89 |
| 3,825,485 | 7/1974 | Coons et al. | 208/97 |
| 3,894,937 | 7/1975 | Bonacci et al. | 208/80 |
| 3,923,638 | 12/1975 | Bertolacini et al. | 208/89 |
| 3,957,622 | 5/1976 | Gatsis | 208/89 |
| 4,016,067 | 4/1977 | Fischer et al. | 208/89 |
| 4,054,508 | 10/1977 | Milstein et al. | 208/89 |
| 4,292,166 | 9/1981 | Gorring et al. | 208/97 |
| 4,421,633 | 12/1983 | Shih et al. | 208/89 |
| 4,613,425 | 9/1986 | Higashi et al. | 208/89 |
| 4,761,220 | 8/1988 | Beret et al. | 208/89 |

*Primary Examiner*—Helane Myers

*Attorney, Agent, or Firm*—Alexander J. McKillop; Charles J. Speciale; Laurence P. Hobbes

[57] ABSTRACT

This invention provides a fixed bed of nonuniformly sized grade catalyst particles for hydrocracking or hydrodesulfurization. The graded particles are arranged with the largest particles in either the upstream or the downstream portion of the bed. In either case, when compared with the conventional bed of uniformly sized particles, the graded bed of this invention shows enhanced hydrocarbon conversion activity for heavy oils over a useful range of conversion. Such catalyst bed is particularly useful in moderate hydrocracking operating at less than 1000 psig (7000 kPa) pressure.

5 Claims, 2 Drawing Sheets

HYDROCONVERSION PROCESS

This invention is concerned with an improved hydroconversion process. In particular, it is concerned with hydrocracking and hydrodesulfurization of heavy hydrocarbon oils, particularly heavy petroleum oils.

BACKGROUND OF THE INVENTION

Environmental concerns, especially with sulfur oxides and nitrogen oxides emissions, have led petroleum refiners to depend more heavily than in the past on hydrodesulfurization and hydrocracking processes. Availability of by-product hydrogen from naphtha reforming no doubt has also cooperated to foster this dependence. Other factors too, have come into play to make hydroprocessing of increasing importance. Among these factors is that high quality crude oils for lube and fuels refineries are expected to progressively become more scarce. Also, refineries that include a fluid catalytic cracking (FCC) plant generate large volumes of dealkylated, aromatic refractory effluents, commonly known as FCC Cycle Oils. Decrease in demand for the fuel oil products into which these FCC Cycle Oils were previously incorporated has to the practice of working them off by incorporation with a hydrocracker feedstock. The hydrocracking process, unlike catalytic cracking, is able to effectively upgrade these otherwise refractory materials.

Hydrocracking is an established petroleum refining process. The hydrocracking feedstock is invariably hydrotreated before being passed to the hydrocracker in order to remove sulfur and nitrogen compounds as well as metals and, in addition, to saturate olefins and to effect a partial saturation of aromatics. The sulfur, nitrogen and oxygen compounds may be removed as inorganic sulfur, nitrogen and water prior to hydrocracking although interstage separation may be omitted, as in the Unicracking-JHC process. Although the presence of large quantities of ammonia may result in a suppression of cracking activity in the subsequent hydrocracking step, this may be offset by an increase in the severity of the hydrocracking operation.

In the hydrotreater, a number of different hydrogenation reactions take place including olefin and aromatic ring saturation but the severity of the operation is limited so as to minimize cracking. The hydrotreated feed is then passed to the hydrocracker in which various cracking and hydrogenation reactions occur.

In the hydrocracker, the cracking reactions provide olefins for hydrogenation while hydrogenation in turn provides heat for cracking since the hydrogenation reactions are exothermic while the cracking reactions are endothermic; the reaction generally proceeds with generation of excessive heat because the amount of heat released by the exothermic hydrogenation reactions usually is much greater than the amount of heat consumed by the endothermic cracking reactions. This surplus of heat causes the reactor temperature to increase and accelerate the reaction rate, but control is provided by the use of hydrogen quench.

Conventional hydrocracking catalysts combine an acidic function and a hydrogenation function. The acidic function in the catalyst is provided by a porous solid carrier such as alumina, silica-alumina, or by a composite of a crystalline zeolite such as faujasite, Zeolite X, Zeolite Y or mordenite with an amorphous carrier such as silica-alumina. The use of a porous solid with a relatively large pore size in excess of 7A is generally required because the bulky, polycyclic aromatic compounds which constitute a large portion of the typical feedstock require pore sizes of this magnitude in order to gain access to the internal pore structure of the catalyst where the bulk of the cracking reactions take place.

The hydrogenation function in the hydrocracking catalyst is provided by a transition metal or combination of metals. Noble metals of Group VIIIA of the Periodic Table, especially platinum or palladium may be used, but generally, base metals of Groups IVA, VIA and VIIIA are preferred because of their lower cost and relatively greater resistance to the effects of poisoning by contaminants (the Periodic Table used in this specification is the table approved by IUPAC as shown, for example, in the chart of the Fisher Scientific Company, Catalog No. 5-702-10). The preferred base metals for use as hydrogenation components are chromium, molybdenum, tungsten, cobalt and nickel; and, combinations of metals such as nickel-molybdenum, cobalt-molybdenum, cobalt-nickel, nickel-tungsten, cobalt-nickel-molybdenum and nickel-tungsten-titanium have been shown to be very effective and useful.

One characteristic of the conventional hydrocracking catalysts is that they tend to be naphtha directing, that is, they tend to favor the production of naphthas, typically boiling below about 165° C. (about 330° F.) rather than middle distillates such as jet fuel and diesel fuel, typically boiling about 165° C. (about 330° F.), usually in the range of 165° to 345° C. (about 330° to 650° F.). However, the yield of middle distillates may be relatively increased by operating under appropriate conditions. For example, U.S. Pat. No. 4,435,275 to Derr et al. describes a process for producing low sulfur distillates by operating the hydrotreating-hydrocracking process without interstage separation and at relatively low pressures, typically below about 7000 kPa (about 1000 psig). The middle distillate product from this process is an excellent low sulfur fuel oil but it is generally unsatisfactory for use as a jet fuel because of its high aromatic content; this high aromatic content also makes it unsuitable for use as a diesel fuel on its own but it may be used as a blending component for diesel fuels if other base stocks of higher cetane number are available. Conversion is maintained at a relatively low level in order to obtain extended catalyst life between successive regenerations under the low hydrogen pressures used. Relatively small quantities of naphtha are produced but the naphtha which is obtained is an excellent reformer feed because of its high cycloparaffin content, itself a consequence of operating under relatively low hydrogen pressure so that complete saturation of aromatics is avoided.

The use of highly siliceous zeolites as the acidic component of the hydrocracking catalyst will also favor the production of distillates at the expense of naphtha, as described in U.S. Patent Application Ser. No. 744,897 now abandoned, filed June 17, 1985 and its counterpart EU 98,040 to La Pierre et al.

In conventional hydrocracking processes for producing middle distillates, especially jet fuels, from aromatic refinery streams such as catalytic cracking cycle oils, it has generally been necessary to employ high pressure hydrotreating typically about 2000 psig to saturate the aromatics present in the feed so as to promote cracking and to ensure that a predominantly paraffinic/-naphthenic product is obtained. The hydrocracked bottoms fraction is usually recycled to extinction even though it is highly paraffinic (because of the aromatic-selective character of the catalyst) and could form the basis for a paraffinic lube stock of higher value than the distillate produced by cracking it. Thus, the conventional fuels hydrocracker operating with a cycle oil feed not only is demanding in terms of operating requirements (high hydrogen pressure) but also degrades a potentially useful and valuable product.

A significant departure in hydrocracking is described in U.S. Patent Application Ser. No. 379,421 now abandoned and its counterpart EU 94,827. The catalyst used in the process is Zeolite Beta, a zeolite found to have a combination of unique and highly useful properties. Zeolite Beta, in contrast to conventional hydrocracking catalysts, has the ability to attack paraffins in the feed in preference to the aromatics. The effect of this is to reduce the paraffin content of the unconverted fraction in the effluent from the hydrocracker so that it has a relatively low pour point. By contrast, conventional hydrocracking catalysts such as the large pore size amorphous materials and crystalline aluminosilicates previously mentioned, are aromatic selective and tend to remove the aromatics from the hydrocracking feed in preference to the paraffins. This results in a net concentration of high molecular weight, waxy paraffins in the unconverted fraction so that the higher boiling fractions from the hydrocracker retain a relatively high pour point (because of the high concentration of waxy paraffins) although the viscosity may be reduced (because of the hydrocracking of the aromatics present in the feed). The high pour point in the unconverted fraction has generally meant that the middle distillates from conventional hydrocracking processes are pour point limited rather than end point limited. The specification for products such as light fuel oil (LFO), jet fuel an diesel fuel generally specify a minimum initial boiling point (IBP) for safety reasons but end point limitations usually arise from the necessity of ensuring adequate product fluidity rather than from any actual need for an end point limitation in itself. In addition, the pour point requirements which are imposed effectively impose an end point limitation of about 345° C. (about 650° F.) with conventional processing techniques because inclusion of higher boiling fractions including significant quantities of paraffins will raise the pour point above the limit set by the specification. When Zeolite Beta is used as the hydrocracking catalyst, however, the lower pour point of the unconverted fraction enables the end point for the middle distillates to be extended so that the volume of the distillate pool can be increased. Thus, the use of Zeolite Beta as the acidic component of the hydrocracking catalyst effectively increases the yield of the more valuable components by reason of its paraffin selective catalytic properties.

Another characteristic of Zeolite Beta is that it affects removal of waxy paraffinic components from the feed by isomerization as well as by conventional cracking reactions. The waxy paraffinic components, comprising straight chain end paraffins and slightly branched chain paraffins, especially the monomethyl paraffins, are isomerized by Zeolite Beta to form iso-paraffins which form excellent lubricant bases because the iso-paraffins possess the high viscosity index characteristic of paraffins without the high pour point values which are characteristic of the more waxy paraffins. A process employing this property of Zeolite Beta for dewaxing feeds to produce low pour point distillates and gas oil is described in U.S. Pat. No. 4,419,220.

Catalytic hydrodesulfurization is a well known process. Representative of prior art catalysts used for hydrodesulfurization are those alumina containing catalysts that include as hydrogenation component nickel and molybdenum or cobalt and molybdenum, the hydrogenation components being in the forms of metal or metal compounds. Phosphorus also is often present. Silica may be present in various modifications of such catalysts. An outstanding distinction between hydrocracking and hydrodesulfurization catalysts is that the former includes a strongly acidic component to enhance hydrocarbon cracking, while the latter catalyst is only mildly acidic to limit hydrocarbon cracking. U.S. Pat. No. 3,546,105 to Jaffe is incorporated herein by reference for background purposes, as are all of the other patents cited in the previous paragraphs.

The catalysts described in the previous paragraph are known to be effective for catalytic hydrodesulfurization of heavy hydrocarbon feedstocks, particularly feedstocks such as vacuum gas oils which may have an appreciable nitrogen content, that do not contain appreciable amounts of heavy residual materials. Although such catalysts also promote denitrogenation, a very important application is desulfurization of feedstocks for use as low sulfur heavy fuel to conform with air pollution requirements.

We have now found that a hydroconversion process for hydrocracking or hydrodesulfurizing a heavy oil feed contaminated with nitrogen can be improved by a simple physical modification of the catalyst bed, and without a need for changing the catalyst composition.

It is an object of this invention to provide a novel fixed bed of hydrocracking or hydrodesulfurization catalyst particles wherein the catalyst particles in either the upstream portion (top) or the downstream portion (bottom) of said catalyst bed is of larger particle size than the remainder of said bed, whereby imparting increased catalytic activity to said bed.

It is a further object of this invention to provide an improved hydrocracking or hydrodesulfurization process which utilizes the above-described bed of catalyst.

It is a still further object of this invention to provide an improved Moderate Pressure Hydrocracking Process (MPHC) wherein a fixed bed of hydrocracking catalyst comprising Zeolite Beta is used, and wherein nonuniform particle-sized catalyst is disposed in the fixed bed in the manner described above.

These and other objects will become evident to one skilled in the art on reading this entire specification and amended claims.

SUMMARY OF THE INVENTION

This invention concept, in one embodiment, provides a fixed bed of nonuniformly sized hydrocracking or hydrodesulfurization catalyst particles for use with a heavy oil feed contaminated with organic nitrogen compounds, said catalyst particles being disposed along the length of the catalyst bed to provide either the upstream portion or the downstream portion of said catalyst bed with a larger particle size than the remainder of said catalyst bed, whereby imparting increased activity for said hydrocracking or hydrodesulfurization to said fixed bed of graded, nonuniformly sized catalyst particles, all as more fully described hereinbelow.

In another embodiment of this invention, an improved process for hydrocracking or hydrodesulfurization is provided by contacting a heavy oil feed under conversion conditions with a fixed bed of graded, nonuniformly sized catalyst particles.

DETAILED DESCRIPTION AND BEST MODE

Figure 1:
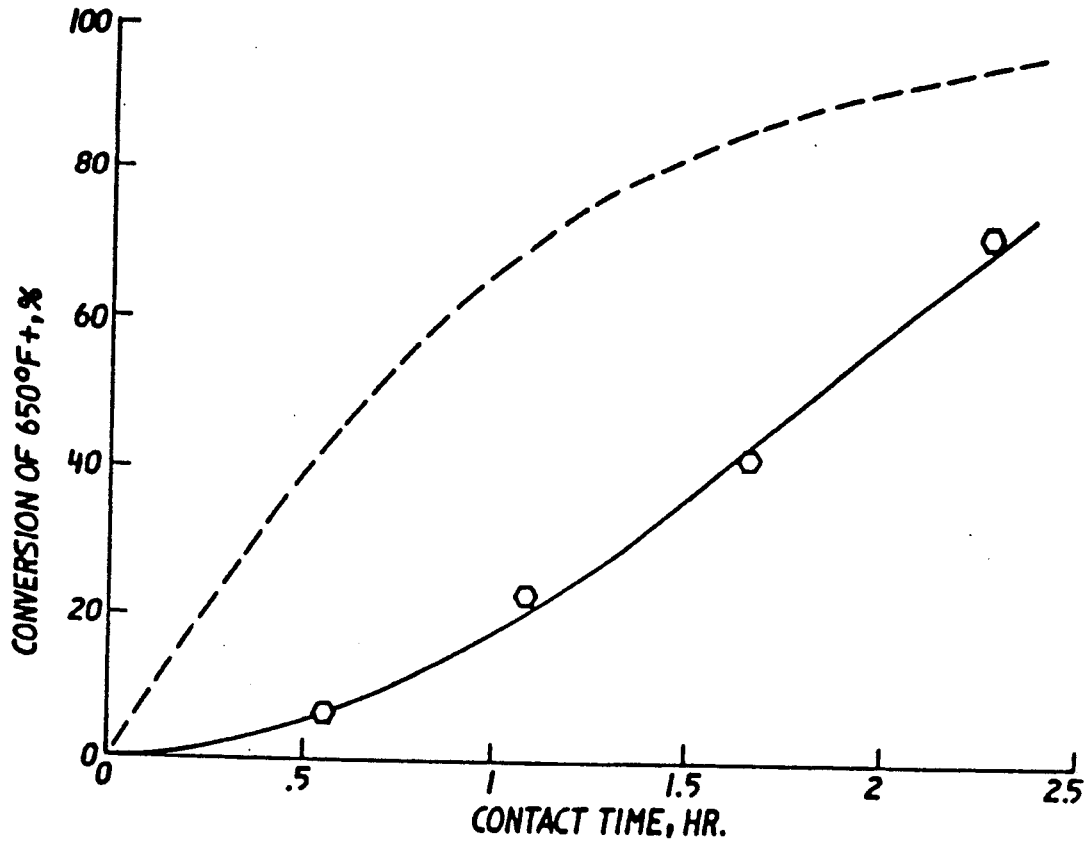
FIG. 1. Prior Art Conversion and Simulation (Example 1).

Without wishing to be bound by theory, the concept process of the present invention may be rationalized as follows.

It is generally known that the zeolite-based hydrocracking reaction is strongly inhibited by nitrogen-containing organic compounds in the feedstocks. It occurred to us that, in such a situation, the effectiveness factor for the hydrocracking reaction could be greater than one (1) if the denitrogenation reaction were diffusion controlled. This is so because the hydrocracking activity inside the pore could be higher than the activity at the pore mouth.

Derivations of Effectiveness Factors

Kinetically, the denitrogenation and hydrocracking reactions can be expressed as the following:

$$R_n = -K_n{*}C_n \quad \text{(Eq. 1)}$$

$$R_c = -(K_c{*}C_c) / (1 + k_{na}{*}C_n) \quad \text{(Eq. 2)}$$

Where:

$R_n$ and $R_c$ are the reaction rates for the denitrogenation and hydrocracking reactions, respectively;

$K_n$ and $K_c$ are the first-order rate constants for the denitrogenation and hydrocracking reactions, respectively;

$C_n$ and $C_c$ are the concentrations for organic nitrogen and hydrocarbons (e.g. in the 650° F. bottoms), respectively; and, $k_{na}$ is the adsorption constant for the nitrogen-containing organic compounds.

To calculate the effectiveness factor for the denitrogenation reaction a straight forward, first-order reaction is used. For a sphere of radius R, the general diffusion/reaction can be expressed by:

$$D_n\left(\frac{d^2C_n}{dr^2} + \frac{2}{r}\frac{dC_n}{dr}\right) = K_nC_n \quad \text{(Eq. 3)}$$

Rendering (Eq. 3) dimensionless by setting $f = C_n/C_{ns}$ and $x = r/R$, we obtain:

$$\frac{d^2f}{dx^2} + \frac{2}{x}\frac{df}{dx} = \frac{R^2K_n}{D_n}f \quad \text{(Eq. 4)}$$

Let $R^2 K_n C_n/D_n = \phi_n^2$ and $f = z/x$, where $\phi_n$ is the Thiele modulus and $D_n$ is the diffusion coefficient of the nitrogen-containing compounds; these reduce into:

$$\frac{d^2Z}{dx^2} = \phi_n^2 Z \quad \text{(Eq. 5)}$$

The boundary conditions are:

$$\text{at } x = 0: df/dx = 0$$
$$\text{at } x = 1: z = 1 \quad \text{(Eq. 6)}$$

The analytical solution of Eq. (4) is:

$$z = fx = (\sinh \phi_n X)/(\sinh \phi_n)$$

or $$f = \frac{C_n}{C_{ns}} = \frac{\sinh \phi_n X}{X \sinh \phi_n} \quad \text{(Eq. 7)}$$

Eq. (7) provides the concentration profile of nitrogen-containing compounds within the spherical reaction phase. The effectiveness factor by the definition under isothermal conditions can be expressed by:

$$\eta_n = \frac{\frac{1}{R}\int_0^R C_n dr}{C_{ns}} \quad \text{(Eq. 8)}$$

Hence we have merely to integrate Eq. (7) in accord with Eq. (8) to obtain:

$$\eta_n = \frac{3}{\phi_n}\left(\frac{1}{\tanh \phi_n} - \frac{1}{\phi_n}\right) \quad \text{(Eq. 9)}$$

For the hydrocracking reaction, we replace the Thiele modulus by a modified Thiele modulus defined as:

$$\phi_c^2 = \frac{R^2 K_c C_c}{D_c(1 + k_{na}C_n)} \quad \text{(Eq. 10)}$$

and Eq. (7) can be used to calculate the concentration profile of the hydrocarbons.

$$f = \frac{C_c}{C_{cs}} = \frac{\text{Sinh } \phi_c x}{x \sinh \phi_c} \quad \text{(Eq. 11)}$$

Similar to Eq. (8), the effectiveness factor for the hydrocracking reaction becomes:

$$\eta_c = \frac{\frac{1}{R}\int_0^R \frac{C_c}{1 + k_nC_n} dr}{\frac{C_{cs}}{1 + k_{na}C_{ns}}} \quad \text{(Eq. 12)}$$

To calculate the effectiveness factor for the hydrocracking reaction, it requires simultaneous calculation of local nitrogen concentration, which can be obtained from Eq. (7), and numerical integration of Eq. (12). The foregoing relationships are those used in the examples which follow.

EXAMPLES

It is believed that description and understanding of this invention will best be advanced by now illustrating the invention with examples. The examples are non-limiting, and are not to be construed as constraining the scope of the invention, said scope being determined by this entire specification, including appended claims.

EXAMPLE 1

In this example, a gas oil was hydrocracked in a pilot plant with a bed of uniformly-sized particles (prior art) in order to obtain denitrogenation and hydrocracking data. A hydrotreated Arabian Light gas oil containing 230 ppmw Nitrogen was used as feed. The properties of the gas oil are shown in Table I. This feed was hydrocracked over a NiW Zeolite-Beta catalyst having the composition and properties shown in Table II. Hydrocracking was conducted at 760° F., 800 psig total pressure with hydrogen gas recirculation of 4000 scf/bbl, and at contact times of 0.56, 1.09, 1.65 and 2.28 hours. The catalyst used in the experiment was a 1/16th inch extrudate having an effective spherical particle radius of 0.1 cm. The experimental results (650° F.+conversion vs contact time) are shown as the four circles in FIG. 1. The following parameters, which were estimated from the experimental data, were used to derive kinetically the conversion profile shown as the solid line in FIG. 1. The broken line shows the expected profile in the total absence of nitrogen.

$K_n = K_c = 0.0005\ sec^{-1}$ $K_{na} = 100000$ (weight fraction)$^{-1}$ $D_n = D_c = 10^{-5}\ cm^2/sec$ $C_{no} = 230$ ppmw $C_{co} = 98.5$ wt%

As shown in FIG. 1, the kinetic calculations and the experimental results conform very closely to each other.

EXAMPLE 1(a)

Figure 4:
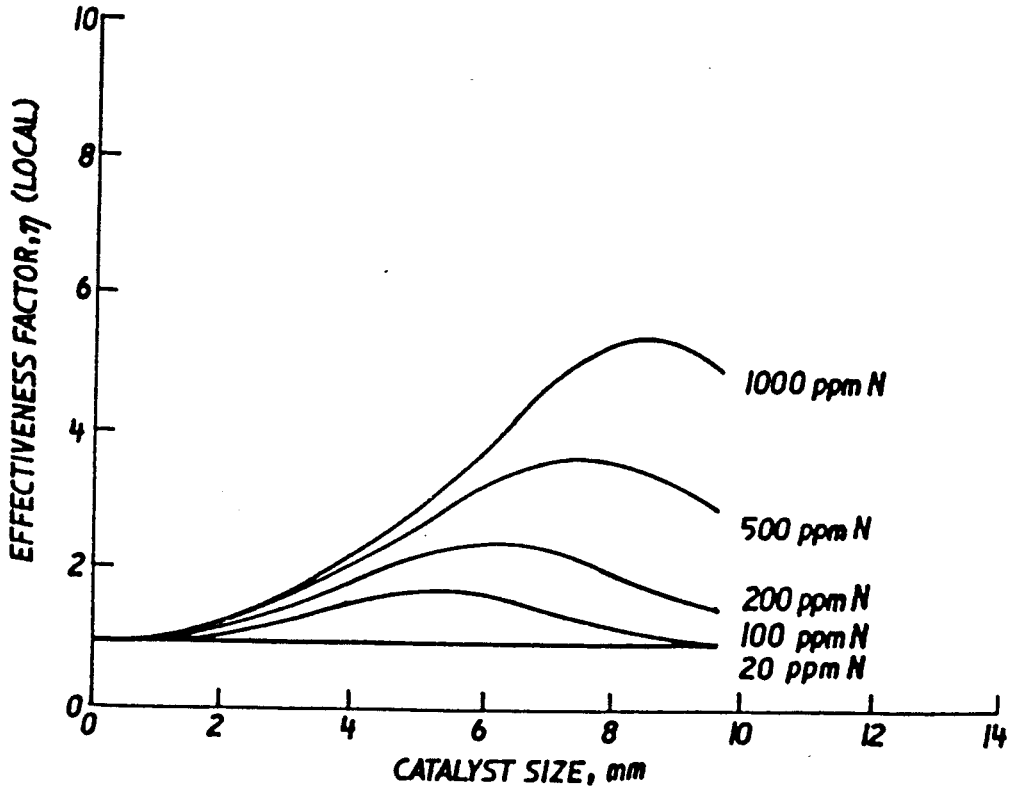
FIG. 4. Local Effectiveness Factor for Cracking.

This example illustrates calculation of the (local) effectiveness factor for cracking as a function of catalyst particle size and for various (local) concentrations of nitrogen. Such calculations are made using Equation 12 shown above, together with the kinetic constants derived in Example 1. FIG. 4 of the drawing shows the results of such calculations. These results suggest that the magnitude of the enhanced activity achieved by the method of this invention will be greater the higher the total nitrogen content of the feed.

EXAMPLE 2

Figure 2:
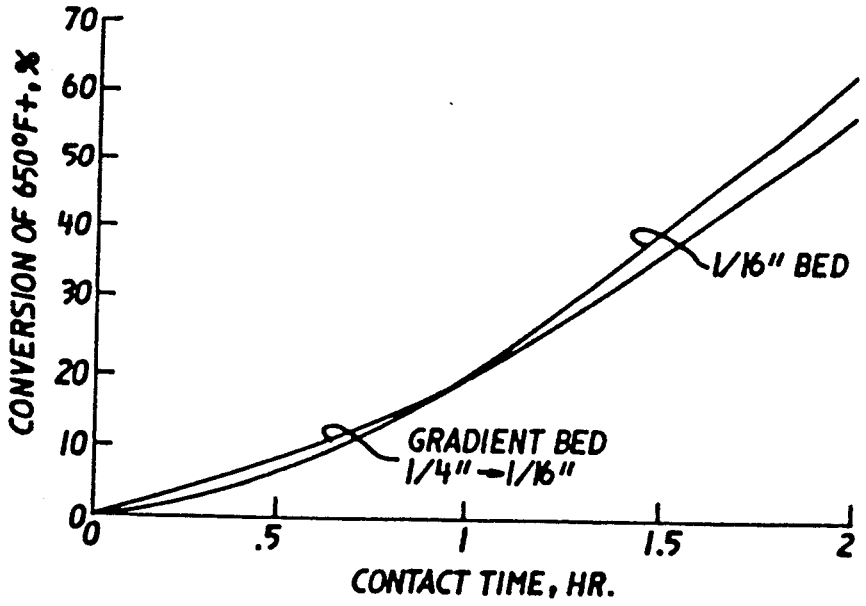
FIG. 2. Simulated Conversion, Gradient Bed (Example 2).

Based on the kinetic parameters obtained in Example 1, a simulation (kinetic calculations) was made for a reactor filled with large particle size catalyst (¼ inch) at the top (upstream end) of the reactor, and with small particle size catalyst (1/16 inch) at bottom of the reactor. The conversion conditions were the same as those used in Example 1. The results of this simulation, along with the curve resulting from using a bed of uniform 1/16 inch particle size catalyst, are shown in FIG. 2. As can be seen from this drawing, the nonuniform bed provides a range of hydrocarbon conversion (about 0 to 22%) over which enhanced activity is achieved. At higher conversions, i.e. above about 22%, the nonuniform bed produced lower conversions than those obtained with the bed of uniformly-sized particles.

It becomes clear from this example that providing a gradation of catalyst particle size within the catalyst bed develops a useful range of conversion over which enhanced hydrocarbon conversion is achieved with no change of catalyst composition.

TABLE I

| Hydrotreated Vacuum Gas Oil Feed | | |
|---|---|---|
| H-NMR | PCT | 13.31 |
| NITROGEN-CHEMILUMINESCE | PPM | 230 |
| BASIC NITROGEN-TITN, PPM | PPM | 53.9 |
| SULFUR BY XRF, 0.002-5 | PCT | 0.42 |
| API GRAVITY | | 27.9 |
| AROMATICITY | PCT | 20 |
| ANILINE POINT | | 190 |
| POUR POINT | | 90 |
| KINEMATIC VISCOSITY, 40° C. | | 31 |
| KINEMATIC VISCOSITY, 100° C. | | 5.358 |
| SIM. DISTILLATION, °F. | | D2887 |
| IBP | | 625 |
| 5 PCT OFF | | 672 |
| 10 PCT OFF | | 689 |
| 20 PCT OFF | | 715 |
| 30 PCT OFF | | 739 |
| 40 PCT OFF | | 764 |
| 50 PCT OFF | | 791 |
| 60 PCT OFF | | 818 |
| 70 PCT OFF | | 848 |
| 80 PCT OFF | | 883 |
| 90 PCT OFF | | 929 |
| 95 PCT OFF | | 960 |
| END POINT | | 1030 |

TABLE II

| Properties of Ni-W Zeolite Beta Catalyst (Catalyst contains 50 wt % Zeolite Beta prior to metals addition) | |
|---|---|
| Physical Properties | |
| Packed Density, g/cc | 0.73 |
| Particle Densit , g/cc | 1.15 |
| Surface Area, | 292 |
| Pore Volume, cc/g | 0.558 |
| Pore Diameter, Angstroms | 76 |
| Chemical Compositions, wt % | |
| Nickel | 4.0 |
| Tungsten | 15.5 |

EXAMPLE 3

This example was a repetition of EXAMPLE 2, except that the slope of the catalyst gradation was reversed. Instead of a uniform gradation from ¼ inch catalyst at the upstream end of the bed to 1/16 inch at the downstream end, the catalyst was arranged with the 1/16 inch at the upstream end of the bed.

Figure 3:
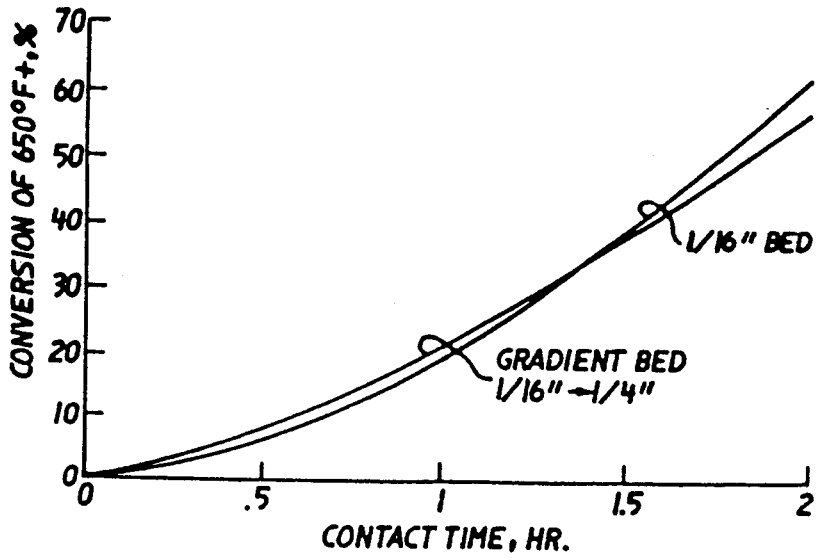
FIG. 3. Simulated Conversion, Gradient Bed (Example 3).

FIG. 3 clearly shows a result qualitatively similar to that for Example 2, but with greater enhancement of activity and a wider range of conversion (from 0 to about 35% instead of 0 to about 22%). It is evident from this example and Example 2 that the bed of graded nonuniformly sized catalyst particles is effective with the larger particles situated either upstream or downstream of the smaller particles.

Although modelling was used in the above examples to demonstrate the present invention, the invention can also be made by use of a pilot plant (when such is available) by providing the necessary graded fixed bed and comparing its conversion profile with that of a fixed bed of particles of uniform size.

Catalyst Bed—grading, particle size and shape

The present invention provides a hydroconversion process in which the fixed bed of catalyst is physically configured so that up to 50 percent of the upstream portion of the catalyst bed is provided with catalyst having larger or smaller particle size than the remainder of the bed. Specifically, the invention requires that the bed of catalyst: (1) contain nonuniformly sized particles, i.e. at least two different sizes of particles; and, (2) that these be graded in the direction of flow of the feed so that the larger particles are placed either upstream or downstream along the bed. The bed, however, may contain more than two different sizes, such as three to twenty, for example, thus providing a gradation of many steps, and for modelling purposes at least, a uniform gradient of infinitely short steps may be assumed. Any of the foregoing physical arrangements of two or more particle sizes are contemplated as operative for purposes of the present invention. However, to avoid trivial enhancement of hydrocracking or hydrodesulfurization activity, it is recommended that the effective spherical particle diameter (see below) of the largest particles be at least 20 percent larger than that of the smallest particles.

The range of catalyst particle sizes that may be used in the practice of the present invention is limited at the lower end by pressure drop. In general, this lower limit is reached with, e.g., extrudate particles having a diameter of about 1/32 inch. The maximum particle size is limited by the diffusivity of the particles and practical manufacturing of the catalysts. However, it is noted that the largest particles need be only slightly larger than the smallest to produce a range of conversion exhibiting enhanced hydrocracking activity, as illustrated by Examples 2 and 3 above.

Any conventional shaped particle may be used in the practice of this invention. As known to those skilled in the art, for hydraulic pressure drop or mass and heat transfer purposes, an effective (or equivalent) spherical particle diameter can be readily computed from the geometry of the particle.

For any non-spherical shaped particle, the effective (or equivalent) spherical particle diameter D, is given by Equation (A):

$$D=6/S_v \qquad \text{(Eq. A)}$$

wherein $S_v$, the specific surface of a particle is given by Equation (B) as:

$$S_v=S_p/v_p \qquad \text{(Eq. B)}$$

wherein $v_p$ is the volume of a particle an $S_p$ its surface area. Since for a spherical particle $S_v=6\ D_{sph}$, wherein $D_{sph}$ is the actual diameter, the effective diameter D and the spherical diameter, $D_{sph}$ are identical. (See "Momentum, Heat and Mass Transfer", second edition, by C. O. Bennett and J. E. Myers, McGraw-Hill Book Company, esp. page 209, for a description of effective diameters of shaped particles.)

For purposes of the present invention, the term "effective spherical diameter" means D as defined in Equation A above, and encompasses particles of any shape, non-limiting examples including spheres, rods, discs, tubes and trilobes. The particles of larger effective spherical particle diameter used in the upstream portion of the fixed bed may have the same shape as, or a different shape than the particles in the remainder of the bed.

Whenever the term "particle size" or "particle diameter" is used herein without being qualified further (such as by reference to "extrudate" of 1/16 inch diameter), it means the actual particle size of spherical particles or the effective spherical particle diameter of a shaped particle.

Feedstocks

The feedstocks contemplated as useful in the hydrocracking or hydrodesulfurization process of this invention may be characterized as high boiling point feeds of petroleum origin, although feeds of other origin may also be employed such as feeds from synthetic oil production processes such as Fischer-Tropsch synthesis. In general, the feeds will have a boiling point above about 600° F., with many having an initial boiling point of about 650° F. Typical feeds which may be processed include atmospheric gas oils, vacuum gas oils and coker gas oils, particularly coker heavy gas oils. In some instances, light cycle oils from fluid catalytic cracking units (FCCU) may be used as a portion of the feed to this process. In general, it is contemplated to substantially exclude from the feed to the process of this invention heavy oils that contain a significant amount of asphaltenes, such as reduced crude. Another characteristic of the feeds useful in this invention is the presence of a significant amount of nitrogen. In general, it is contemplated that the feed, or blend of stocks constituting the feed, will contain between 10 and about 5000 ppm total nitrogen. The reason why the present invention is particularly useful and preferably used with nitrogen-contaminated feeds will become apparent in the paragraphs which follow.

Tables I, III, IV and V are illustrative of feeds that are useful and within the scope of the present invention.

TABLE III

| VGO Properties | |
|---|---|
| API Gravity | 23.2 |
| Distillation, wt % | |
| 225°-345° C. (440°-650° F.) | 7.0 |
| 345°-400° C. (650°-750° F.) | 17.0 |
| 400° C.+ (750° F.+) | 76.0 |
| Sulfur, wt % | 2.28 |
| Nitrogen, ppmw | 550 |
| Pour Point, °C. (°F.) | 18 (95) |
| KV @ 100° C., cSt | 5.6 |
| P/N/A, wt % | 29/21/50 |

TABLE IV

| Arab Light HVGO | |
|---|---|
| API Gravity | 22.2 |
| Hydrogen, wt % | 12.07 |
| Sulfur, wt % | 2.45 |
| Nitrogen, ppmw | 600 |
| CCR, wt % | 0.4 |
| P/N/A, wt % | 24/25.3/50.7 |
| Pour Point, °C. (°F.) | 40 (105) |
| KV @ 100° C., cSt | 7.0 |
| Distillation (D-1160), pct. | |
| IBP | 345 (649) |
| 5 | 358 (676) |
| 10 | 367 (693) |
| 50 | 436 (817) |
| 90 | 532 (989) |
| 95 | 552 (1026) |
| FBP | 579 (1075) |

TABLE V

| FCC LCO Properties | |
|---|---|
| API Gravity | 21.0 |
| TBP, 95%, °C. (°F.) | 362 (683) |
| Hydrogen, wt % | 10.48 |
| Sulfur, wt % | 1.3 |
| Nitrogen, ppmw | 320 |
| Pour Point °C. (°F.) | −15 (5) |

TABLE V-continued

| FCC LCO Properties | |
|---|---|
| Distillation, wt % | |
| 215° C.– (420° F.–) | 4.8 |
| 215°-345° C. (420°-650° F.) | 87.9 |
| 345°-425° C. (650°-800° F.) | 7.3 |

The foregoing description has made liberal references to the hydrocracking process and the hydrocracking catalyst. However, it is contemplated that the process would also be effective for hydrodesulfurization. The hydrodesulfurization catalyst, although characterized by much lower cracking activity, is known to be poisoned by organic nitrogen compounds in the feed, just like the hydrocracking catalyst. Also, like the hydrocracking catalyst, it possesses inherent denitrogenation activity. Thus, configuring the hydrodesulfurization catalyst bed as described above for hydrocracking would lead to more effective removal of organic sulfur from the feed.

It is an advantageous aspect of this invention that its benefits do not depend on change of the catalyst material, but only on change of particle size as described above. Thus, a known, established catalyst may be used without change of chemical composition and without change of any physical properties except particle size or shape, avoiding protracted and costly pilot plant studies usually associated with new catalyst materials. Another advantageous aspect is that use of the nonuniform bed of catalyst provides a lower pressure drop than a reference bed formed of the smaller, uniform sized particles.

It is contemplated that the improvement in hydrocarbon conversion of a heavy oil feed provided by the process of the present invention is applicable to any hydrocracking process including one in which an amorphous acidic solid such as silica-alumina is used as the sole cracking component. However, because hydrocracking catalyst compositions that include a crystalline zeolite component are known to be particularly sensitive to poisoning by organic nitrogen compounds, processes which use such zeolite catalysts will be more advantageously affected by use of the process of the present invention. In a particularly preferred embodiment, hydrocracking processes that are designed to operate at moderate pressure, such as at a pressure of not more than 1000 psig (7000 kPa), and with a zeolite such as Zeolite Beta, such as described in EU 94,827, are most particularly preferred.

The improvement in hydrocarbon conversion of a heavy oil feed provided by the process of the present invention may be used as such if deeper conversion is economically advantageous. Alternatively, the refiner may choose to increase the throughput of feed (i.e. increase the liquid hourly space velocity), thereby reducing conversion, if plant capacity is a limiting factor in productivity. Another option provided by the present invention is to reduce operating temperature, thereby extending on-stream time between regenerations and/or catalyst life. All and any combinations of the above process modifications are contemplated as within the scope of the present invention.

What is claimed is:

1. In a hydrocarbon conversion process for hydrocracking or hydrodesulfurizing a heavy oil feed contaminated with organic nitrogen compounds, said process comprising contacting under conversion conditions said oil and hydrogen gas with a fixed bed of uniformly sized particles of hydrocracking or hydrodesulfurization catalyst, said catalyst having diffusion-limited capability for denitrogenating said organic nitrogen compounds, the improvement comprising:

providing a fixed bed of catalyst particles of different sizes wherein the upstream portion of said catalyst bed is of larger particle size than the remainder of said catalyst bed, whereby imparting increased activity for said hydrocracking or hydrodesulfurization to said fixed bed of nonuniformly sized catalyst particles; and, contacting said heavy oil feed with said fixed bed of nonuniformly sized catalyst particles.

2. The process described in claim 1 wherein the smallest particles have an effective spherical particle diameter of at least 0.04 centimeters and the largest have an effective spherical particle diameter of not more than 3 centimeters.

3. In a process for hydrocracking a heavy oil feed contaminated with organic nitrogen compounds, said process comprising hydrotreating said feed over a hydrotreating catalyst in the presence of hydrogen gas at elevated temperature and at a pressure of not mroe than 1000 psig (7000 kPa), and contacting said hydrotreated oil without intermediate separation and hydrogen gas at elevated temperature and at a pressure of not more than 1000 psig (7000 kPa) with a fixed bed of uniformly sized particles of zeolitic hydrocracking catalyst, said catalyst having diffusion-limited capability for denitrogenating said organic nitrogen compounds remaining in said hydrotreated oil, the improvement comprising:

providing a fixed bed of graded catalyst particles of different sizes wherein the upstream portion of said catalyst bed is of larger particle size than the remainder of said catalyst bed, whereby imparting increased activity for said hydrocracking to said fixed bed of nonuniformly sized catalyst particles; and, contacting said heavy oil feed with said fixed bed of nonuniformly sized catalyst particles at a volume conversion of less than 50 percent.

4. The hydrocracking process described in claim 3 wherein said zeolitic hydrocracking catalyst comprises Zeolite Beta.

5. The process described in claim 4 including the step of reducing the severity of the hydrocracking step by lowering the hydrocracking temperature, increasing the space velocity, or a combination thereof whereby maintaining a volume conversion in the range of about 20 to about 40 volume percent.

* * * * *